US005416286A

United States Patent [19]

Dixon, Jr.

[11] Patent Number: 5,416,286

[45] Date of Patent: May 16, 1995

[54] HIGH AMPERAGE, HIGH EFFICIENCY ELECTRICAL SLIDE SWITCH ASSEMBLY WITH PLUG AND SOCKET CONTACTS

[76] Inventor: Alfred R. Dixon, Jr., 4023 Far Hill, Bloomfield Hills, Mich. 48304

[21] Appl. No.: 139,505

[22] Filed: Oct. 19, 1993

[51] Int. Cl.[6] ..... H01H 15/06

[52] U.S. Cl. ..... 200/16 E; 200/16 R; 218/1

[58] Field of Search ..... 200/1 V, 16 R, 16 B–16 F, 200/17 R, 18, 61.08, 81 R–83 R, 144 R, 61.45 R, 61.45 M, 61.5, 61.52, 61.53; 307/10.7

[56] References Cited

U.S. PATENT DOCUMENTS

| | | | |
|---|---|---|---|
| 1,752,213 | 3/1930 | Treanor | 200/16 E |
| 2,931,874 | 4/1960 | Leaman | 200/61.08 X |
| 2,999,912 | 9/1961 | Kincaid et al. | 200/61.08 X |
| 3,599,167 | 8/1971 | Adrian et al. | 200/51.09 |
| 3,793,501 | 2/1974 | Stonestrom | 200/61.08 |
| 3,806,870 | 4/1974 | Kalajian | 200/82 R X |
| 3,830,992 | 8/1974 | Guaglione | 200/150 R |
| 4,000,388 | 12/1976 | Carter et al. | 200/554 |
| 4,000,408 | 12/1976 | McCartney | 307/10.7 |
| 4,176,284 | 11/1979 | Higgs | 307/10.7 |
| 4,321,438 | 3/1982 | Emenegger | 200/61.45 R |
| 4,563,549 | 1/1986 | Lycan | 200/1 V |
| 4,657,335 | 4/1987 | Koch et al. | 439/851 |
| 4,734,063 | 3/1988 | Koch et al. | 439/844 |
| 4,737,603 | 4/1988 | Lycan | 200/18 |
| 4,798,968 | 1/1989 | Deem | 307/10.7 |
| 4,866,222 | 9/1989 | Clark et al. | 200/16 E |
| 5,034,620 | 7/1991 | Cameron | 307/10.7 |
| 5,216,212 | 6/1993 | Golowash et al. | 200/1 V |

FOREIGN PATENT DOCUMENTS

| | | | |
|---|---|---|---|
| 2265240 | 9/1993 | United Kingdom | B60L 3/00 |

*Primary Examiner*—J. R. Scott

*Attorney, Agent, or Firm*—Basile and Hanlon

[57] ABSTRACT

A high amperage switch is provided for interrupting flow of power through a circuit. First and second connectors are connected in the circuit with the circuit being open between the first and second connectors. An electrically conductive bridging member includes first and second complementary-shaped connectors respectively mateable with the first and second connectors for electrically coupling the first and second connectors together when the bridging member is in the closed position and interrupting the circuit when the bridging member is in an open position. The bridging member is moveable between the closed and opened positions. The present invention is particularly well adapted for use in a vehicle having an electrical circuit for supplying power from a battery on the vehicle to at least one electrical component used on the vehicle.

29 Claims, 4 Drawing Sheets

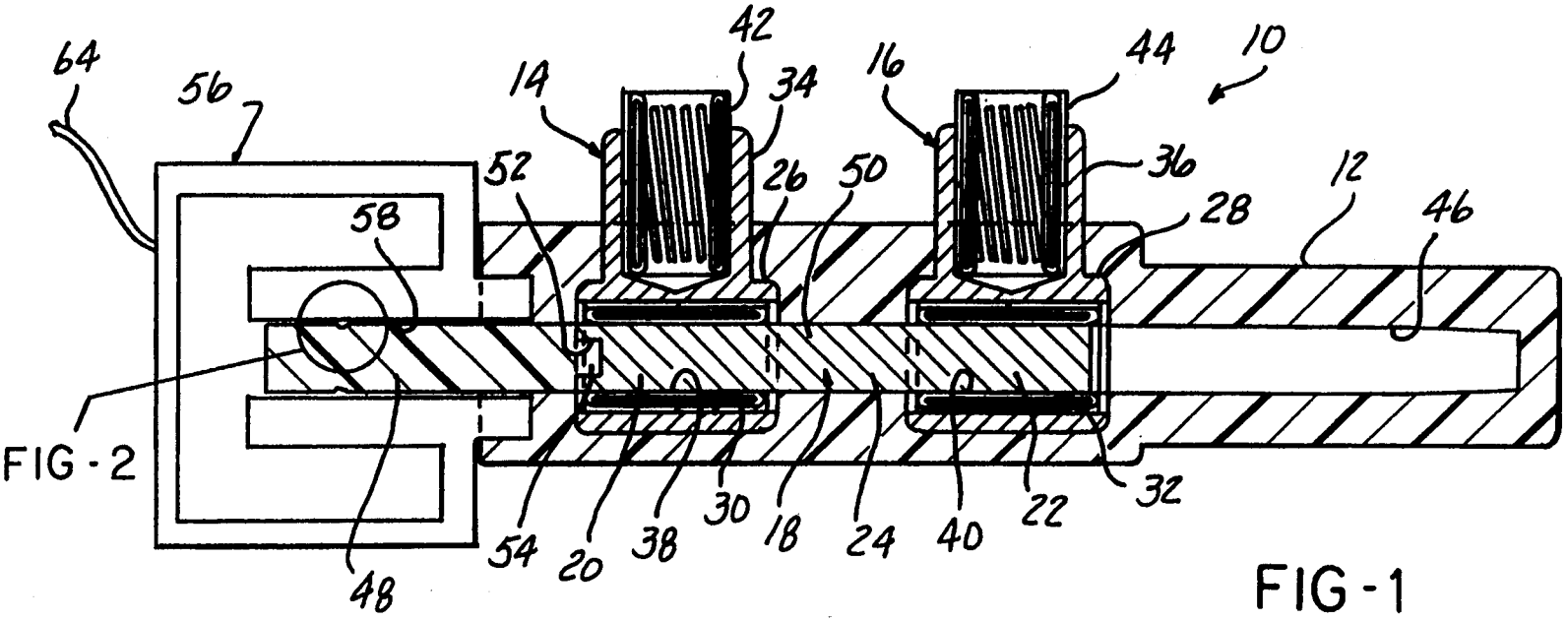
FIG-1
FIG-2
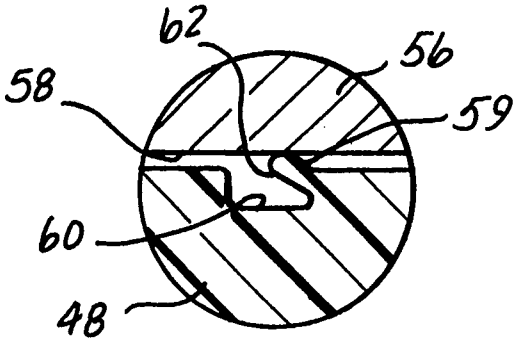
FIG-2

HIGH AMPERAGE, HIGH EFFICIENCY ELECTRICAL SLIDE SWITCH ASSEMBLY WITH PLUG AND SOCKET CONTACTS

FIELD OF THE INVENTION

The present invention relates to a high amperage switch for interrupting flow or transferring (or switching) the flow of power through an electrical circuit and, in particular, the present invention provides improved electrical efficiency and is particularly well-adapted for use in many stationary circuits or for use in a vehicle having an electrical circuit for supplying power from a battery to at least one electrical component to interrupt the flow of power through the circuit.

BACKGROUND OF THE INVENTION

Fires commonly occur after a vehicle crash or collision. A fire can occur when the vehicle's fuel tank is ruptured and the resulting spilled fuel is ignited by an electrical spark. Therefore, it would be beneficial if vehicles were equipped with a mechanism that was activated during a crash or collision, which resulted in the shut-off of electrical power to the vehicle thus eliminating electrical sparks.

The present invention provides such a mechanism. The present invention is adapted for use in any electrical switching environment. The present invention uses a radially resilient electrical socket of the type sometimes referred to as a barrel terminal. In barrel terminals, conductor strips or wires are stretched and extend through the interior of a cylindrical sleeve from a first circumferential location at one end of the sleeve to a second circumferential location at the opposite end of the sleeve which is angularly displaced about the sleeve axis from the first circumferential location. A plurality of such strips so mounted within a cylindrical sleeve collectively lie on a surface of revolution of a general hourglass shape whose diameter varies from a minimum diameter midway between the ends of the sleeve and a maximum diameter at the ends of the sleeve. When a cylindrical electric contact of a diameter intermediate the minimum and maximum diameters referred to above is inserted into such a barrel terminal, the conductor strips will collectively exert a radially resilient grip on the contact. This type of barrel terminal and a method for making the barrel terminal is disclosed in U.S. Pat. No. 4,657,335 and U.S. Pat. No. 4,734,063. Commercially available connectors suitable for use in the present invention are sold under the names of Hypertronics' Hypertrac, Elcon Helix, Elcon Crown or RAD-SOK®. Other commercially available connectors suitable for use in the present invention do not use angularly displaced wires, instead these connectors use parallel wires that have been bent or forced concave by a circumferential spring. Such a barrel terminal with parallel wires is sold under the name of O.D.U. Springtac™ and Compliant Conductive Connections CCC™ contact.

SUMMARY OF THE INVENTION

It is desirable in the present invention to provide a switch capable of connecting and disconnecting an electrical circuit for use as a safety blow-out fuse or as a relay switch. It is further desirable in the present invention to provide a switch that can be readily installed in a vehicle. In addition, it is desirable in the present invention to provide a high amperage switch which is capable of switching between a first connection, an off position and a second connection.

In a vehicle having an electrical circuit for supplying power from the battery on the vehicle to at least one electrical component used on the vehicle, the present invention provides a high amperage switch for interrupting or transferring (or switching) the flow of power through the circuit. The high amperage switch can include a housing having inlet and outlet connectors adapted to receive an electrical inlet connection and an electrical outlet connection. The high amperage switch also can include moveable bridging means for connecting the inlet and outlet connectors when in a first position, and for disconnecting the inlet and outlet connectors when in a second position.

In one embodiment of the present invention, the moveable bridging means may include a slide moveable within the housing between the first and second positions, and carrying complementary connectors adapted to engage with the inlet and outlet connectors. The outlet connector of the housing may include at least one female connector disposed in a first sidewall of the housing adjacent the first position or first end on a path of travel of the slide between the first and second positions. The complementary connector of the slide may include at least one male connector adapted to be slidable received within the female connector when the slide is in the first position. The outlet connector of the housing may also include at least one female connector disposed in a second sidewall of the housing opposite from the first sidewall and adjacent a third position or second end on the path of travel of the slide. The inlet connection is connectible with the first outlet connector when the slide is in the first position, and is connectible with the second outlet connector when the slide is in the third position. The inlet connection can be disconnected from both the first outlet connector and the second outlet connector when the slide is in the second position.

The inlet connection may include a continuous, constant connection to the slide while the slide moves between the first and second positions. The inlet connector of the housing may include at least one elongated electrically conductive rod extending substantially along an entire side of the housing parallel to a path of travel of the slide between the first and second positions. A complementary connector of the slide includes at least one female connector slidably received on the metal rod for sliding engagement therealong between the first and second positions. The inlet connector of the housing may include at least one flexible elongated conductor attached at one end to the slide and at another end to a stationary position on a wall of the housing, such that the slide is capable of movement between the first and second positions. The bridging means may be adapted for connecting a plurality of inlet and outlet connectors when in the first position and for disconnecting the plurality of inlet and outlet connectors when in the second position.

In another embodiment of the present invention, the bridging means may include an elongated metal rod extending substantially between and connecting the inlet and outlet connectors while in a normal first position. The metal rod is displaceable longitudinally to a second position for disconnecting the inlet and outlet connectors. Actuator means is provided for moving the bridging means between the first and second positions.

The actuator means may include an insulating rod disposed within the housing coaxial with the metal rod for driving engagement therewith in longitudinal direction. Means for driving the insulating rod longitudinally within the housing is used to move the metal rod from the first position to the second position. The means for driving may be selected from a group including a propellant, a spring, an explosive and a compressed fluid or gas.

The high amperage switch of the present invention may be used for interrupting flow of power through a circuit. The switch may include first and second connectors connected in the circuit such that the circuit is open between the first and second connectors. Electrically conductive bridging means has first and second complementary-shaped connectors respectively mateable with the first and second connectors for electrically coupling the first and second connectors together when the bridging means is in a closed position and interrupting the circuit when the bridging means is in an open position. Means for moving the bridging means between the closed and opened positions is also provided.

In a preferred form of the present invention, at least one of the first and second connectors is selected from a group including a barrel terminal and a mating cylindrical electrical contact. The bridging means may include a slide moveable within the housing between the open and closed positions, and carrying the complementary-shaped connectors adapted to engage with the first and second connectors. The second connector of the housing may include at least one first barrel terminal disposed in a first sidewall of the housing adjacent the closed position on a path of travel of the slide between the open and closed positions. A complementary-shaped connector of the slide may include at least one first cylindrical electric contact adapted to be slidably received within the first barrel terminal when the slide is in the closed position.

The second connector of the housing may also include at least one second barrel terminal disposed in a second sidewall of the housing opposite from the first sidewall and adjacent an alternate closed position on a path of travel of the slide. The first connection is connectible with the first connector when the slide is in the closed position, and is connectible with the second connector when the slide is in the alternate closed position. The slide allows the first connection to be disconnected from both the first connector and the second connector when the slide is in the open position. The first connection may include a continuous constant connection to the slide while the slide moves between the open and closed positions. The first connector of the housing may include at least one elongated cylindrical electric contact extending substantially along an entire side of the housing parallel to a path of travel of the slide between the open and closed positions. The complementary-shaped connector of the slide may include at least one barrel terminal slidably received on the cylindrical electric contact for sliding engagement therealong between the open and closed positions.

The first connector of the housing may include at least one flexible elongated conductor attached at one end to the slide and at another end to a stationary position on a wall of the housing, such that the slide is capable of movement between the open and closed positions. The bridging means may be adapted for connecting a plurality of first and second connectors when in the closed position and for disconnecting the plurality of first and second connectors when in the open position. The bridging means may also include an elongated cylindrical electric contact extending substantially between and connecting the first and second connectors when in a normal closed position. The cylindrical electric contact is displaceable longitudinally to the open position for disconnecting the first and second connectors. The means for moving the bridging means may include an elongated cylindrical insulating rod disposed within the housing coaxial with the cylindrical electric contact for driving engagement therewith in longitudinal direction, and means for driving the insulating rod longitudinally within the housing to move the cylindrical electric contact from the closed position to the open position. The means for moving the bridging means may be selected from a group including a propellant, an explosive, a compressed fluid, compressed gas, pressurized liquid, spring-loaded mechanism, capacitor driven solenoid or linear electric motor.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a cross-sectional view of a high amperage switch according to a first embodiment of the present invention;

FIG. 2 is an enlarged detailed view of an elongated cylindrical insulating rod according to the first embodiment of the present invention taken as shown in FIG. 1;

DETAILED DESCRIPTION OF THE PREFERRED AND ALTERNATIVE EMBODIMENTS

Figure 3:
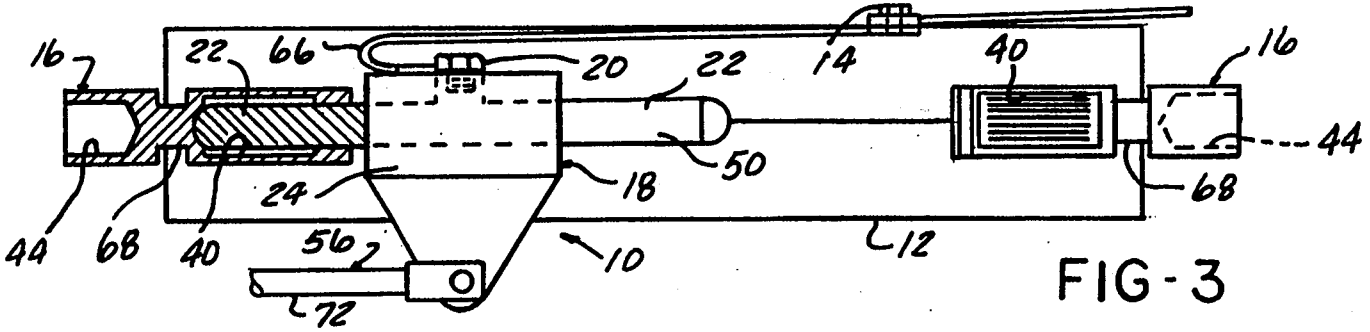
FIG. 3 is a cross-sectional schematic view of a high amperage switch according to a second embodiment of the present invention while in a first closed position.

A high amperage switch 10, according to the present invention, for interrupting flow of power through a circuit is illustrated in FIGS. 1–7. The high amperage switch 10 of the present invention can be adapted for use in a vehicle having an electrical circuit for supplying power from a battery on the vehicle to at least one electrical component used on the vehicle. The high amperage switch 10 in its simplest form preferably includes a housing 12 having a first connector, or inlet connector 14 and a second connector, or outlet connector 16. The first and second connectors, 14 and 16 respectively, are adapted to receive an electrical inlet connection and an electrical outlet connection. Moveable, electrically conductive, bridging means 18 connects the inlet and outlet connectors, 14 and 16 respectively, when in a first position or closed position and disconnect the inlet and outlet connectors, 14 and 16 respectively, when in a second position or open position. The connectors, 14 and 16, are connected in a circuit, such that the circuit is open between the first and second connectors, 14 and 16 respectively. The bridging means 18 has first and second complementary-shaped connectors, 20 and 22 respectively, mateable with the first and second connectors, 14 and 16 respectively, for electrically coupling the first and second connectors together when the bridging means 18 is in a closed position and interrupting the circuit when the bridging means 18 is an open position. The bridging means 18 may include a slide 24 moveable within the housing 12 between the first and second positions. The slide 24 carries the complementary-shaped connectors, 20 and 22, which are adapted to engage with the inlet and outlet connectors, 14 and 16 respectively.

Referring now specifically to FIGS. 1 and 2, the housing 12 in this embodiment is elongated along at least one dimension. The slide 24 may take the form of an elongated electrically conductive member 50 having a longitudinal axis disposed parallel to the elongated axis of the housing 12. Preferably, the slide 24 is in the form of an elongated cylindrical electrically conductive member 50 having a relatively uniform cross-section throughout its longitudinal length. The inlet connector and outlet connector, 14 and 16 respectively, may include electrically conductive T-shaped members, H-shaped members or other electrically conductive fittings 26, 28 having main passageways 30, 32 passing straight-through one portion with generally perpendicular portions 34, 36 attached to the walls of the respective fitting defining the straight-through passages. The straight-through passages 30, 32 of each inlet and outlet connector pair disposed having longitudinal axes of the straight-through passageways coaxially aligned with one another. The electrically conductive fittings 26 and 28 may include a barrel terminal or other radially resilient terminals 38 and 40 disposed within the respective main straight-through passageways 30 and 32. The terminals 38 and 40 define a coaxially extending aperture spaced a predetermined distance from one another to define an open circuit. The slide 24 passes coaxially through each terminal 38 and 40 to close the open circuit. The perpendicular portions 34 and 36 extend radially outwardly from the fittings, 26 and 28 respectively, and may include an inlet terminal 42 and an outlet terminal 44. The inlet terminal 42 is adapted to receive an inlet connection from a power source and the outlet terminal 44 is adapted to receive an outlet connector for supplying power to at least one electric component of the vehicle. The electrically conductive, moveable bridging means 18 may include first and second complementary-shaped connectors, 20 and 22, disposed within the terminals 38 and 40 of the electrically conductive, fittings, 26 and 28, to close the circuit. The housing 12 defines an open pocket or chamber 46 adapted to receive and decelerate the moveable bridging means 18 when in a second position to open the circuit by disconnecting the inlet connector 14 from the outlet connector 16.

An electrically insulating member 48 has an elongated longitudinal axis disposed coaxially with the longitudinal axis of the elongated electrically conductive member 50. The electrically conductive member 50 may include a longitudinally extending aperture 52 adjacent the insulating member 48 adapted to receive a longitudinally protruding portion 54 of the insulating member 48 to maintain the coaxial alignment between the insulating member 48 and the conductive member 50. The insulating member 48 extends longitudinally externally of the housing means 12. Actuator means 56 is connectible to the housing means 12 enclosing the external portion of the insulating member 48 within an aperture 58.

As best seen in FIG. 2, the insulating member 48 may include annular seal means 59 for suppressing a trailing arc during switching between the closed circuit position and the open circuit position. The annular seal means 59 may take the form of an added plastic, such as TEFLON ®, or rubber lip seal 62 positioned on an external surface of the insulating member 48, or may take the form of a piston ring-type seal. The ability of the annular seal means 59 to control the arc is an important feature of this embodiment of the invention. The annular seal means 59 is preferably, and most cost effectively, formed as at least one annular groove 60 integrally molded in the insulating member 48. The annular groove 60 preferably is at least partially defined by a radially extending lip seal 62 forming the annular seal means 59. The lip seal 62 when formed in a plurality of longitudinally spaced positions from one another provide means for controlling arcing between the fittings 26 and 28 and the electrically conductive member 50, as the conductive member 50 is forced from the main passageways 30 and 32 by the insulating member 48. The lip seal 62 is preferably formed on a sidewall of the groove 60 longitudinally closest to the conductive member 50 and extending radially outwardly at an angle in a trailing direction with respect to the travel or movement of the insulating member 48 when moving from the normal first position as shown in FIG. 1, where the conductive member 48 closes the circuit between the inlet connector 14 and the outlet connector 16, and the second position, where the conductive member 50 is displaced longitudinally to the right as shown in FIG. 1, so that there is an open circuit between inlet connector 14 and outlet connector 16 with the insulating member 48 disposed therebetween to prevent arcing. The illustrated embodiment is well-suited for applications requiring a high amperage, high efficiency, safety blow-out fuse. By way of non-limiting example, this switch would be appropriate for use in automatically disconnecting a vehicle battery or bank of batteries in the event of a collision.

Preferably, the housing means 12 is made of an insulating material such as plastic or the like. The insulating member 48 is also preferably made of a non-conductive material, such as plastic. The conductive member 50 may be made of a suitable electrically conductive metal material.

The actuator means 56 can take a variety of forms. The actuator means 56 can include a propellant, explosive, compressed fluid, compressed gas, pressurized liquid, spring-loaded mechanism, capacitor driven solenoid or linear electric motor for driving the insulating member in longitudinal direction toward the conductive member 50 to move the bridging means 18 from the closed circuit position to an open circuit position. In the preferred form of this embodiment, a propellant would be used for moving the insulating member 48. The control means 64 for triggering the propellant would be similar to that currently used in triggering the deployment of airbag safety devices in motor vehicles.

Figure 4:
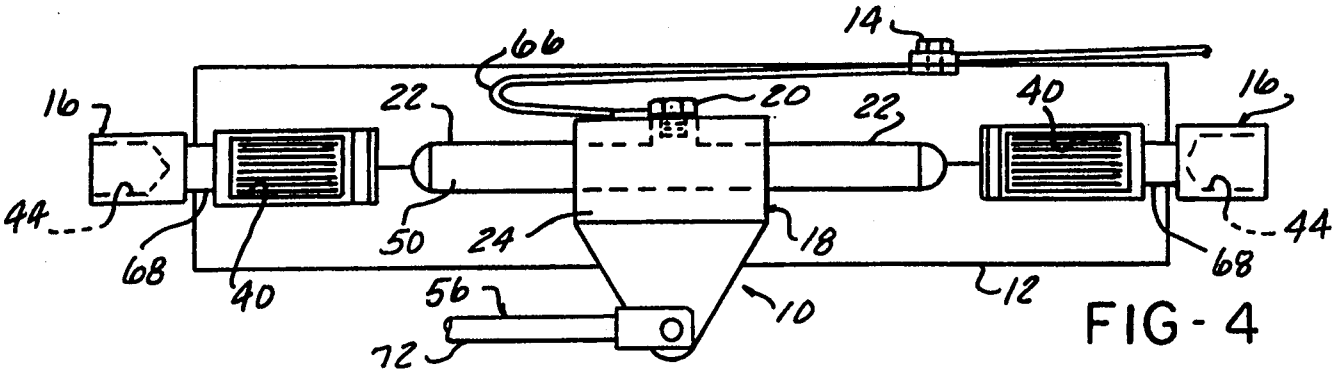
FIG. 4 is a cross-sectional schematic view of the high amperage switch shown in FIG. 3 while in an open position.
Figure 5:
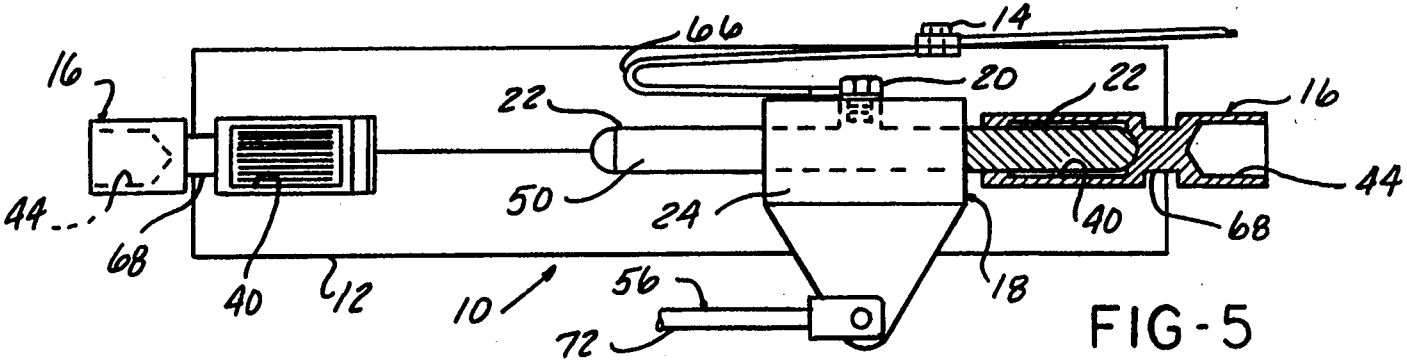
FIG. 5 is a cross-sectional schematic view of the high amperage switch shown in FIG. 3 in an alternate closed position.

Referring now to FIGS. 3–7, an alternative embodiment of the present invention is illustrated. Simplified, somewhat schematic cross-sectional views of this embodiment are shown in FIGS. 3–5 illustrating various positions as the slide 24 moves along its path of travel. The high amperage switch 10 preferably includes a non-conductive, insulating housing means 12. An inlet connector 14 and an outlet connector 16 are connected to the housing means 12. Moveable bridging means 18 is disposed within the housing means 12 for electrically connecting the inlet and outlet connectors when in a first position, such as is shown in FIG. 3, and for disconnecting the inlet and outlet connectors when in a second position, such as is shown in FIG. 4. The inlet connector 14 of this configuration may include at least one flexible, elongated, conductor 66 attached at one end to the slide 24 and at another end to a stationary position on a wall of the housing means 12, such that the slide 24 is capable of movement between the first and second positions. First and second complementary-shaped connectors, 20 and 22 respectively are carried on the slide 24 to engage with the inlet and outlet connectors, 14 and 16 respectively.

Figure 6:
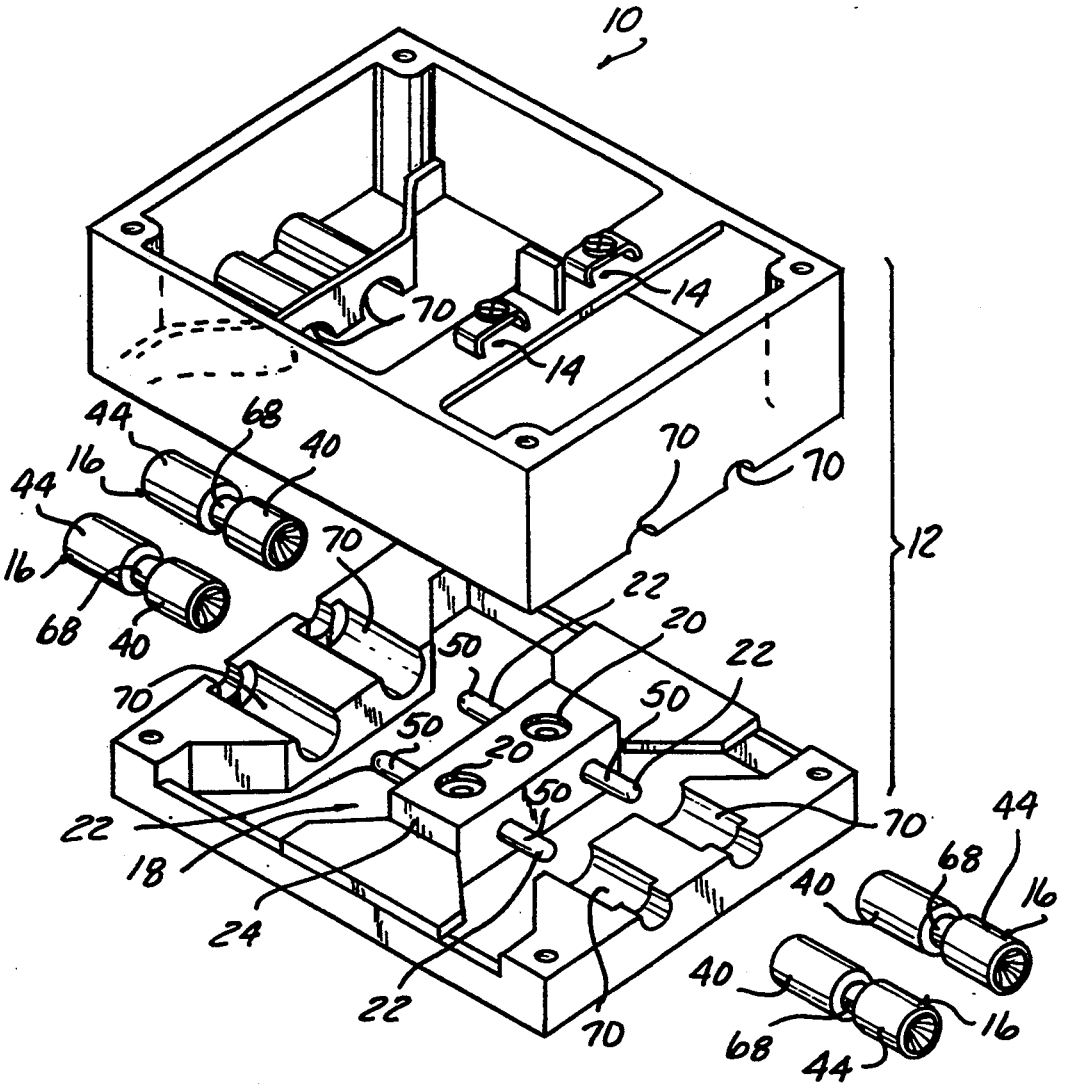
FIG. 6 is a perspective exploded view of a multiple high amperage switch according to the second embodiment of the present invention as shown in cross-section in FIGS. 3–5.
Figure 7:
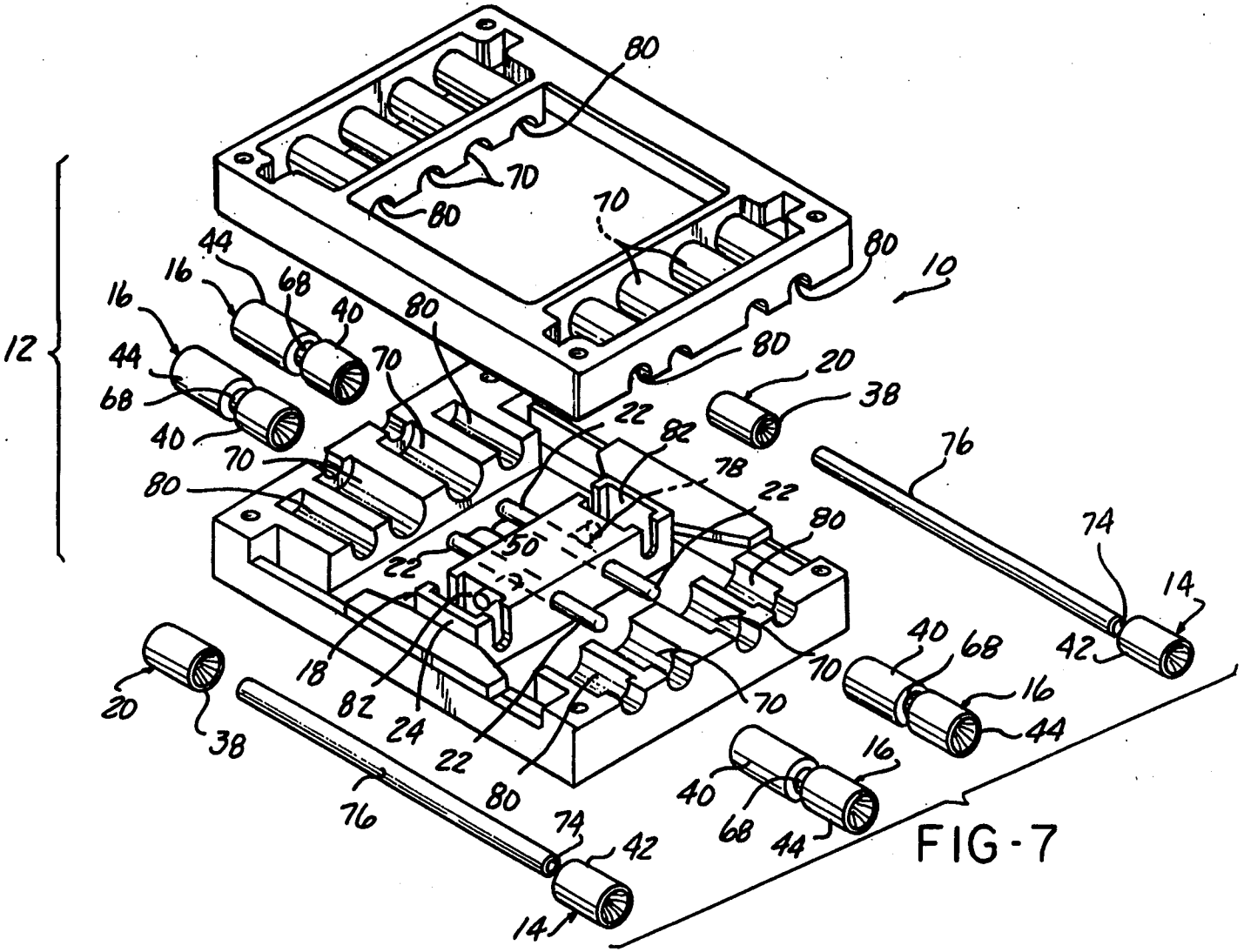
FIG. 7 is a perspective exploded view of a high amperage switch capable of switching multiple inlet and outlet connections according to a third embodiment of the present invention.

In the illustrated configuration, two alternative outlet connectors 16 are provided on opposite ends of the housing means 12. The outlet connectors 16 preferably include a barrel terminal 40 and outlet barrel terminal 44 connected to one another by a reduced diameter portion 68. The reduced diameter portion 68 allows the outlet connectors 16 to be fixedly positioned with respect to the housing means 12 by placement in appropriately shaped receiving pockets 70 in opposite walls of the housing means 12 as best seen in FIGS. 6 and 7. The moveable bridging means 18 is driven along a path within the housing means 12 by actuator means 56 as seen in FIGS. 3–5. The actuator means 56 may include a fluid actuated cylinder including a reciprocal piston rod 72. The moveable bridging means 18 may include the slide 24 which is capable of movement within the housing means 12 between a first position, as illustrated in FIG. 3 connecting the single inlet connector 14 to the left-most outlet connector 16 as illustrated in FIG. 3, to a second disconnected position, as illustrated in FIG. 4 where the single inlet connector 14 is disconnected from both the left-most and right-most outlet connectors 16, and an optional third position connecting the single inlet connector 14 to the right-most outlet connector 16 as illustrated in FIG. 5. Slide 24 carries at least one complementary-shaped connector 22 for engagement with the outlet connector 16. The complementary-shaped connector 22 may include an elongated, electrically conductive member 50 carried by the slide 24 and electrically connected to the first complementary-shaped connector 20 disposed on the upper surface of the slide 24 as illustrated in FIGS. 3–6.

Referring now to FIG. 6, this embodiment of the present invention may include multiple inlet connectors 14 and multiple outlet connectors 16 operable through a single moveable bridging means 18. Certain elements of the exploded views in FIGS. 6 and 7 have been removed or are not illustrated in order to simplify the drawings. For example, the actuator means 56 is not illustrated in either FIG. 6 or FIG. 7, and the flexible elongated conductor 66 is not illustrated in FIG. 6. Elements 56 and 66 can be seen in FIGS. 3–5. The multiple switch of FIG. 6 operates in the same manner as described and illustrated in FIGS. 3–5. The slide 24 is enlarged in a direction transverse to the path of travel of the slide in order to provide two electrically independent bridging means 18 supported in a single moveable slide 24 between a first position to connect the plurality of inlet connectors 14 to the plurality of outlet connectors 16, disposed in the left-hand side of the housing as illustrated in FIG. 6, and a second position, intermediate the opposite ends of the housing means 12, so that the plurality of inlet connectors 14 are disconnected or isolated from the plurality of outlet connectors 16. In addition, the housing means 12 may be provided with additional outlet connectors 16 in an opposite wall of the housing means 12 from the first position outlet connector 16, such that the slide 24 is moveable to a third position to connect the conductive members 50 to an alternative set of barrel terminals 40 position on the right-hand side of the housing means 12 as illustrated in FIG. 6.

Referring now to FIG. 7, this embodiment of the high amperage switch 10 is identical to that described for FIGS. 2–6 with the exception of the inlet connector 14. In this configuration, the inlet connector 14 may include an inlet barrel terminal 42 disposed external of the housing means 12 and connected by a reduced diameter portion 74 to an elongated, electrically conductive, metal rod 76 extending substantially along an entire side of the housing means 12 parallel to a path of travel of the slide means 24 between the first and second positions, and optionally the third position. A complementary-shaped connector 20 is slidably received on the metal rod 76 for sliding engagement therealong between the first and second positions, and optionally the third position of the slide. The complementary-shaped connector 20 may take the form of a barrel terminal 38 and is electrically connected to the conductive member 50 as illustrated at 78. The reduced diameter portion 74 and metal rod 76 are received in appropriately shaped pockets 80 formed in the housing means 12. The complementary-shaped connector 20 is captively held within a pocket 82 formed in the slide 24. As the slide 24 moves between the first position, second position and optionally the third position, the barrel terminal 38 slidably engages along the metal rod 76 while maintaining an electrically conductive connection between the inlet connector 14 and the conductive member 50. In its simplest form, the high amperage switch of the present invention according to the embodiment as illustrated in FIG. 7 may include at least one inlet connector 14 having an elongated metal rod extending substantially along an entire side of the housing means 12 parallel to a path of travel of the slide 24. If desired, a plurality of inlet and outlet connectors, 14 and 16 respectively can be provided. The slide 24 can be manually actuated, or automated. The actuator means 56 can be connected to the slide 24 as illustrated in FIGS. 3–5. The actuator means 56 can include a propellant, an explosive, a fluid, compressed gas, pressurized liquid or spring-loaded mechanism. As illustrated in FIGS. 3–7, alternate outlet connectors may be provided at opposite ends of the path of travel of the slide means 24, if desired. The outlet connectors 16 may be provided in singular form, or in configurations providing the connection of a plurality of outlet connectors 16 for a single inlet connector 14, or a plurality of outlet connectors 16 for connection to a plurality of inlet connectors 14 carried by a single slide for simultaneous actuation.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In an electrical circuit for supplying power from a power source to at least one electrical component, a switch for selectively interrupting and transferring a flow of power through the circuit comprising:

a split housing having inlet and outlet connectors, said split housing having a generally planar parting line with pockets defined in opposed parting surfaces for receiving at least one of said inlet and outlet connectors, said pockets formed adjacent at least one side edge extending from an external position outside of said housing to an internal position within said housing; and moveable bridging means for connecting the inlet and outlet connectors when in a first position and for disconnecting the inlet and outlet connectors when in a second position.

2. The switch of claim 1 wherein said bridging means comprises:

a slide moveable along a fixed linear path coplanar with said planar parting line within said housing between said first and second positions and carrying complementary-shaped connectors to engage with at least one of said inlet and outlet connectors.

3. The switch of claim 2 further comprising:

said outlet connector of said housing including at least one first female connector disposed in a first sidewall of said housing adjacent said first position on a path of travel of said slide between said first and second positions; and said complementary-shaped connector of said slide including at least one first male connector to be slidably received within said first female connector when said slide is in said first position.

4. The switch of claim 3 further comprising:

said outlet connector of said housing including at least one second female connector disposed in a second sidewall of said housing opposite from said first sidewall and adjacent a third position on a path of travel of said slide, such that said inlet connection is connectible with said first outlet connector when said slide is in said first position and is connectible with said second outlet connector when said slide is in said third position, while allowing said inlet connection to be disconnected from both the first outlet connector and the second outlet connector when said slide is in the second position.

5. The switch of claim 2 further comprising:

said inlet connection including a continuous constant connection to said slide while said slide moves between said first and second positions.

6. The switch of claim 5 further comprising:

said inlet connector of said housing including at least one elongated electrically conductive rod extending substantially along an entire side of said housing parallel to a path of travel of said slide between said first and second positions; and said complementary-shaped connector of said slide including at least one female connector slidably received on said electrically conductive rod for sliding engagement therealong between said first and second positions.

7. The switch of claim 2 further comprising:

said inlet connector of said housing including at least one flexible elongated conductor attached at one end to said slide and at another end to a stationary position on a wall of said housing such that said slide is capable of movement between said first and second positions.

8. The switch of claim 1 further comprising:

said bridging means for connecting at least one inlet connector to at least one of a plurality of outlet connectors and for disconnecting said at least one inlet connector from said plurality of outlet connectors.

9. In an electrical circuit for supplying power from a power source to at least one electrical component, a switch for selectively interrupting and transferring a flow of power through the circuit comprising:

a housing having inlet and outlet connectors to receive an electrical inlet connection and an electrical outlet connection;

moveable bridging means for connecting the inlet and outlet connectors when in a first position and for disconnecting the inlet and outlet connectors when in a second position, said bridging means including an elongated electrically conductive rod extending substantially between and connecting said inlet and outlet connectors while in said normal first position, said electrically conductive rod displaceable longitudinally to said second position for disconnecting said inlet and outlet connectors; and seal means acting between said inlet and outlet connectors during movement of said conductive rod for suppressing a trailing arc during switching said bridging means between said first and second positions.

10. The switch of claim 9 further comprising:

actuator means for moving said bridging means between said first and second positions.

11. The switch of claim 10 wherein said actuator means further comprises:

an electrically insulative rod disposed within said housing coaxial with said electrically conductive rod for driving engagement therewith in longitudinal direction;

means for driving said electrically insulative rod longitudinally within said housing to move said electrically conductive rod from said first position to said second position; and means for decelerating and for receiving said electrically conductive rod formed in said housing.

12. A switch for selectively interrupting and transferring a flow of power through a circuit comprising:

first and second connectors connectible in said circuit with said circuit being open between said first and second connectors;

electrically conductive bridging means having first and second complementary-shaped connectors respectively mateable with said first and second connectors for electrically coupling said first and second connectors together when said bridging means is in a closed position and interrupting said circuit when the bridging means is in an open position;

seal means acting between said inlet and outlet connectors during movement of said conductive rod for suppressing a trailing arc during switching said bridging means between said first and second positions; and means for moving said bridging means between said closed and open positions.

13. A switch for selectively interrupting and transferring a flow of power through a circuit comprising:

first and second connectors connectible in said circuit with said circuit being open between said first and second connectors;

electrically conductive, elongated bridging means disposed having a plurality of longitudinal axes lying in a common plane and having first and second complementary-shaped connectors respectively mateable with said first and second connectors for electrically coupling said first and second connectors together when said bridging means is in a closed position and interrupting said circuit when the bridging means is in an open position, wherein said bridging means includes a non-rotatable slide moveable along a fixed linear path lying in said common plane between said closed and open positions and carrying said complementary-shaped connectors to engage with said first and second connectors; and means for moving said bridging means between said closed and open positions.

14. The switch of claim 13 further comprising:

said second connector including at least one radially resilient first terminal adjacent said closed position on a path of travel of said slide between said closed and open positions; and said complementary-shaped connector of said slide including at least one first cylindrical electric contact to be slidably received within said first terminal when said slide is in said closed position.

15. The switch of claim 14 further comprising:

said second connector including at least one radially resilient second terminal adjacent an alternate closed position on a path of travel of said slide, such that said first connection is connectible with said first connector when said slide is in said closed position and is connectible with said second connector when said slide is in said alternate closed position, while allowing said first connection to be disconnected from both the first connector and the second connector when said slide is in the open position.

16. The switch of claim 13 further comprising:

said first connection including a continuous constant connection to said slide while said slide moves between said closed and open positions.

17. The switch of claim 16 further comprising:

said first connector including at least one elongated cylindrical electric contact extending substantially along and parallel to a path of travel of said slide between said closed and open positions; and said complementary-shaped connector of said slide including at least one radially resilient terminal slidably received on said cylindrical electric contact for sliding engagement therealong between said closed and open positions.

18. The switch of claim 16 further comprising:

said first connector including at least one flexible elongated conductor attached at one end to said slide and at another end to a stationary position such that said slide is capable of movement between said closed and open positions.

19. The switch of claim 14 further comprising:

said bridging means for connecting at least one first connector to at least one of a plurality of second connectors when in said closed position and for disconnecting said at least one first connector from said plurality of second connectors when in said open position.

20. The switch of claim 13 further comprising:

said bridging means for connecting a plurality of first and second connectors when in said closed position and for disconnecting said plurality of first and second connectors when in said open position.

21. The switch of claim 12 further comprising:

said bridging means including an elongated cylindrical electric contact extending substantially between and connecting said first and second connectors while in said normal closed position, said cylindrical electric contact displaceable longitudinally to said open position for disconnecting said first and second connectors.

22. The switch of claim 21 wherein said means for moving further comprises:

an elongated cylindrical insulating rod disposed coaxial with said cylindrical electric contact for driving engagement therewith in longitudinal direction;

means for driving said insulating rod longitudinally to move said cylindrical electric contact from said closed position to said open position; and means for decelerating and for receiving said cylindrical electric contact.

23. The switch of claim 12 further comprising:

at least one of said first and second connectors being selected from a group including a radially resilient terminal and a mating cylindrical electric contact.

24. In an electrical circuit for supplying power from a power source to at least one electrical component, a switch for selectively interrupting and transferring a flow of power through the circuit comprising:

a housing having inlet and outlet connectors adapted to receive an electrical inlet connection and an electrical outlet connection;

moveable bridging means for connecting the inlet and outlet connectors when in a first position and for disconnecting the inlet and outlet connectors when in a second position, said bridging means including an elongated electrically conductive rod extending substantially between and connecting said inlet and outlet connectors while in said normal first position, said electrically conductive rod displaceable longitudinally to said second position for disconnecting said inlet and outlet connectors; and actuator means for moving said bridging means between said first and second positions, said actuating means including an electrically insulative rod disposed within said housing coaxial with said electrically conductive rod for driving engagement therewith in longitudinal direction, means for driving said electrically insulative rod longitudinally within said housing to move said electrically conductive rod from said first position to said second position and seal means acting between said insulative rod and said inlet and outlet connectors for suppressing a trailing arc during switching said bridging means between said first and second positions.

25. The switch of claim 24 further comprising:

said seal means having at least one annular groove formed on said insulative rod.

26. The switch of claim 24 further comprising:

said seal means having at least one radially extending lip seal extending radially outwardly from said insulative rod at an angle in a trailing direction with respect to a direction of travel during switching said bridging means from said first position to said second position.

27. The switch of claim 24 further comprising:

said seal means having at least one annular groove integrally molded in said insulative rod and at least one radially extending lip seal extending radially outwardly at an angle in a trailing direction with respect to a direction of travel during switching said bridging means from said first position to said second position.

28. The switch of claim 27 further comprising:

said lip seal integrally molded in said insulative rod defining a sidewall of said annular groove longitudinally closest to said conductive rod.

29. The switch of claim 24 further comprising:

means for decelerating and for receiving said electrically conductive rod formed in said housing.

* * * * *